US008141969B2

(12) United States Patent
Noguchi

(10) Patent No.: US 8,141,969 B2
(45) Date of Patent: Mar. 27, 2012

(54) PRINT CONTROL APPARATUS, PRINT CONTROL METHOD, AND PROGRAM THEREFOR

(75) Inventor: Hideki Noguchi, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 408 days.

(21) Appl. No.: 12/535,627

(22) Filed: Aug. 4, 2009

(65) Prior Publication Data

US 2010/0026740 A1 Feb. 4, 2010

(30) Foreign Application Priority Data

Aug. 4, 2008 (JP) ..... 2008-200803

(51) Int. Cl.
*B41J 2/195* (2006.01)
*B41J 29/393* (2006.01)

(52) U.S. Cl. ..... 347/7; 347/19

(58) Field of Classification Search ..... 347/7, 19
See application file for complete search history.

(56) References Cited

U.S. PATENT DOCUMENTS 6,343,194 B1 * 1/2002 Shimada ..... 399/28
7,146,114 B2 * 12/2006 Frankel et al. ..... 399/27
2008/0111842 A1 * 5/2008 Hall et al. ..... 347/7

FOREIGN PATENT DOCUMENTS

JP 08-063303 A 3/1996
JP 2009061595 * 3/2009

* cited by examiner

*Primary Examiner* — Julian Huffman
(74) *Attorney, Agent, or Firm* — Kilpatrick Townsend & Stockton LLP

(57) ABSTRACT

Provided is a print control apparatus for controlling a printing apparatus that is able to perform color printing by using coloring agents of a plurality of colors. The print control apparatus includes: a residual amount acquisition section that acquires residual amounts of the coloring agents; a print instruction receiving section that receives instruction for printing an image; a required amount information acquisition section that acquires information on required amounts of the coloring agents required for the image instructed to be printed; and a control section that performs a residual amount precedence print control for controlling the printing apparatus to preferentially perform printing of the image, among a plurality of images instructed to be printed, which requires the smaller amount of the coloring agent having the smallest residual amount on the basis of the acquired information on the required amount and the residual amounts of the coloring agents.

10 Claims, 10 Drawing Sheets

| No | IMAGE | INK USAGE ORDER Isj | | | |
|---|---|---|---|---|---|
| | | 1 | 2 | 3 | 4 |
| 1 |  | C | M | Y | K |
| 2 |  | C | Y | M | K |
| 3 |  | M | K | Y | C |
| 4 |  | Y | M | C | K |
| 5 |  | K | Y | C | M |
| ⋮ | ⋮ | ⋮ | ⋮ | ⋮ | ⋮ |

PRINT CONTROL APPARATUS, PRINT CONTROL METHOD, AND PROGRAM THEREFOR

This application claims priority to Japanese Patent Application No. 2008-200803, filed Aug. 4, 2008, the entirety of which is incorporated by reference herein.

BACKGROUND

1. Technical Field

The present invention relates to a print control apparatus, a print control method, and a program therefor. Specifically, the invention relates to a print control apparatus, a print control method, and a program capable of controlling a printing apparatus that is able to perform color printing by using coloring agents of a plurality of colors. Alternatively, the invention relates to a print control apparatus capable of controlling a printing apparatus that is able to perform color printing by using coloring agents of a plurality of colors and to stop the printing when any one of the coloring agents runs out.

2. Related Art

Print control apparatuses for controlling a printing apparatus that process a plurality of printing requests have been proposed (for example, refer to Japanese Unexamined Patent Application Publication No. H08-63303). In the print control apparatus, printing may be requested from a plurality of users. In such a case, a printing order is set on the basis of priority, which is determined basically by each user in their the printing requests, and in the case of requests having the same priority, the printing order is set so as to preferentially print the request of a printing target document having a smaller number of pages.

As described above, in the description, the number of pages of the printing target document and the priority determined by the user are considered when the printing order is set. However, in the printing apparatus having inks of a plurality of colors, residual amounts of the respective inks are not considered. In such a printing apparatus having inks of the plurality of colors, unbalance in consumption occurs among each of the color inks. Thus, sometimes, some color ink may be just about to run out, and some color ink may have a sufficient residual amount. In such a case, when a printing request for a plurality of images is received, the image, in which a large amount of the ink which is just about to run out has to be used, may firstly be printed in accordance with a certain set printing order, and sometimes directly this may result in the ink running out. In addition, some printing apparatuses are configured so that the inks are formed integrally with each other and are unable to be individually replaced. In such a configuration, when one ink has run out, the other inks having a sufficient residual amount have to be replaced at the same time. Therefore, some of the residual inks are wasted.

SUMMARY

An advantage of some aspects of the invention is to provide a print control apparatus, a print control method, and a program for allowing the printing apparatus, which is able to perform color printing using inks of a plurality of colors, to print as many images as possible before the ink runs out.

The invention adopts the following aspects in order to take the advantage as stated above.

According to a first aspect of the invention, a print control apparatus is provided for controlling a printing apparatus that is able to perform color printing by using coloring agents of a plurality of colors. In addition, the print control apparatus includes: a residual amount acquisition section that acquires residual amounts of the coloring agents; a print instruction receiving section that receives instructions for printing an image; a required amount information acquisition section that acquires information on the necessary amount of the coloring agents required for the requested image to be printed; and a control section that performs a residual amount precedence print control for controlling the printing apparatus to preferentially perform printing of the image, when a plurality of images instructed to be printed, which requires the smaller amount of the coloring agent having the smallest residual amount on the basis of the acquired information on the required amount and the residual amounts of the coloring agents.

In the print control apparatus according to this aspect of the invention, when a plurality of images are instructed to be printed, a residual amount precedence print control is performed on the basis of the required amount information acquired by the required amount information acquisition section and the residual amounts of the coloring agents acquired by the residual amount acquisition section. The residual amount precedence print control is for controlling the printing apparatus to preferentially perform the printing of the image which requires the smaller amount of the coloring agent having the smallest residual amount. With such a configuration, it is possible to delay the time until the coloring agent having a smaller residual amount runs out. As a result, it is possible to allow the printing apparatus, which is able to perform color printing by using the coloring agents having the plurality of colors, to print as many images as possible before the coloring agent runs out. The residual amount of each coloring agent can be indirectly acquired by reducing the usage of ink in the printing operation, a maintenance operation (a nozzle cleaning), and the like from an amount thereof initially inserted at the time of the manufacturing of the cartridge for the containing of the coloring agent. In addition, the residual amount thereof can be directly acquired by using an optical sensor or a weight sensor.

In the print control apparatus according to this aspect of the invention, it is preferred that the residual amount acquisition section be a section for acquiring the residual amounts after each single image has been completely printed. In addition, it is also preferred that the control section be a section for determining the image to be printed next time after each single image has been completely printed. In such a manner, it is possible to more precisely determine the next printing target image on the basis of the latest residual amounts of the coloring agents. In addition, it is also possible to prevent delays required to determine the printing order since only the next printing target image has to be determined.

In the print control apparatus according to this aspect of the invention, it is preferred that the control section be a section for determining the printing order of a plurality of images instructed to be printed prior to the start of the printing. By adopting such a configuration, there is no problem due to the time required to determine the printing order during the printing operation.

In the print control apparatus according to this aspect of the invention, it is preferred that the print control apparatus further include a printing order change instruction receiving section that receives instruction as to whether or not to change the printing order of the plurality of images instructed to be printed by the user. In addition, it is also preferred that the control section be a section for performing the residual amount precedence print control when the printing order change instruction receiving section receives the instruction to change the printing order. In such a manner, it is possible to prevent an image from being printed in a printing order unpredictable to the user.

In the print control apparatus according to this aspect of the invention, it is preferred that the print control apparatus further include a pixel sampling section that extracts a plurality of pixels for sampling from the image to be printed. In addition, it is also preferred that the required amount information acquisition section be a section for acquiring the required amount information from the required amounts of the coloring agents for the extracted sample pixels. In such a manner, it is possible to promptly acquire the required amount information in a simple and easy process as compared with acquiring the required amounts of the coloring agents from the amount actually required to print the whole image.

In the print control apparatus according to this aspect of the invention, it is preferred that the required amount information acquisition section set a ranking for the coloring agents for each image in an ascending or descending order in terms of the required amount of the coloring agents for printing the image, and acquire the set ranking of the coloring agents for each image as the required amount information. In such a manner, it is possible to promptly select the image as compared with the way of comparing the required amount of the coloring agents to each other when selecting the image which requires the smaller amount of the coloring agent from images which require a small amount of the coloring agent having the smallest residual amount.

In the print control apparatus according to this aspect of the invention, it is preferred that the printing apparatus include coloring agents which are formed integrally with each other so that coloring agents cannot be individually replaced. In such a printing apparatus, when one coloring agent runs out, the other coloring agents having sufficient residual amounts have to be replaced at the same time. Therefore, this aspect of the invention is more significant in its application thereto.

In the print control apparatus according to this aspect of the invention, it is preferred that the printing apparatus be an apparatus which stops the printing regardless of the instruction of the printing when any one of the coloring agents has run out. In such a printing apparatus, when the coloring agent has run out, the printing is stopped. Therefore, this aspect of the invention is more significant in its application thereto.

According to a second aspect of the invention, a print control apparatus is provided for controlling a printing apparatus that is able to perform color printing by using coloring agents of a plurality of colors and stops printing when any one of the coloring agents runs out. In addition, the print control apparatus includes: a residual amount acquisition section that acquires the residual amounts of the coloring agents; a print instruction receiving section that receives instructions for the printing of an image; a required amount information acquisition section that acquires information on the required amount of the coloring agents for the requested image to be printed; and a control section that sets a printing order to print the maximum number of a plurality of requested images before any one of the coloring agents runs out on the basis of the acquired information on the required amount and the residual amounts of the coloring agents, and controls the printing apparatus to print the image on the basis of the set printing order.

In the print control apparatus according to this aspect of the invention, when a plurality of images are instructed to be printed, a printing order to print the maximum number of the images before any one of the coloring agents runs out is set on the basis of the required amount information acquired by the required amount information acquisition section and the residual amounts of the coloring agents acquired by the residual amount acquisition section, and the printing apparatus to print the image is controlled on the basis of the set printing order. With such a configuration, it is possible to allow the printing apparatus, which is able to perform color printing by using the coloring agents having the plurality of colors, to print as many images as possible before the coloring agent runs out. Therefore, it is possible to delay the time until the coloring agent having a smaller residual amount runs out.

According to a third aspect of the invention, a print control method is provided for controlling a printing apparatus that is able to perform color printing by using coloring agents of a plurality of colors. In addition, the print control method includes: acquiring residual amounts of the coloring agents; receiving instruction for printing an image; acquiring required amount information on the required amounts of the coloring agents for the requested image to be printed; and performing residual amount precedence print control for controlling the printing apparatus so that there is preferentially perform printing of the image, which requires the smallest amount of the coloring agent having the smallest residual amount, among a plurality of images instructed to be printed, on the basis of the acquired information on the required amount and residual amounts of the coloring agents.

In the print control apparatus according to this aspect of the invention, when a plurality of images are instructed to be printed, a residual amount precedence print control is performed on the basis of the required amount information acquired by the required amount information acquisition section and the residual amounts of the coloring agents acquired by the residual amount acquisition section. The residual amount precedence print control is for controlling the printing apparatus to preferentially perform the printing of the image which requires the smaller amount of the coloring agent having the smallest residual amount. With such a configuration, it is possible to delay the time until the coloring agent having a smaller residual amount runs out. As a result, it is possible to allow the printing apparatus, which is able to perform color printing by using the coloring agents having the plurality of colors, to print as many images as possible before the coloring agent runs out. Furthermore, in the print control method, the print control apparatus may be modified in various forms according to the above-mentioned aspects of the invention, and the steps may be added to execute the functions of the print control apparatus according to the above-mentioned aspects of the invention.

According to a fourth aspect of the invention, a program is provided for causing a computer to execute the print control method mentioned above. This program may be recorded on a computer-readable recording medium (for example, a hard disk, a ROM, an FD, a CD, a DVD, or the like), may be transmitted from a certain computer to another computer through a transmission medium (a communication network such as an internet or a LAN), and may be interchanged in various forms other than those. When the program is executed by one computer or is executed by assigning the steps thereof to a plurality of computers, the steps of the above-mentioned print control method are executed. Hence, the program is able to obtain the same effect as the print control method.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
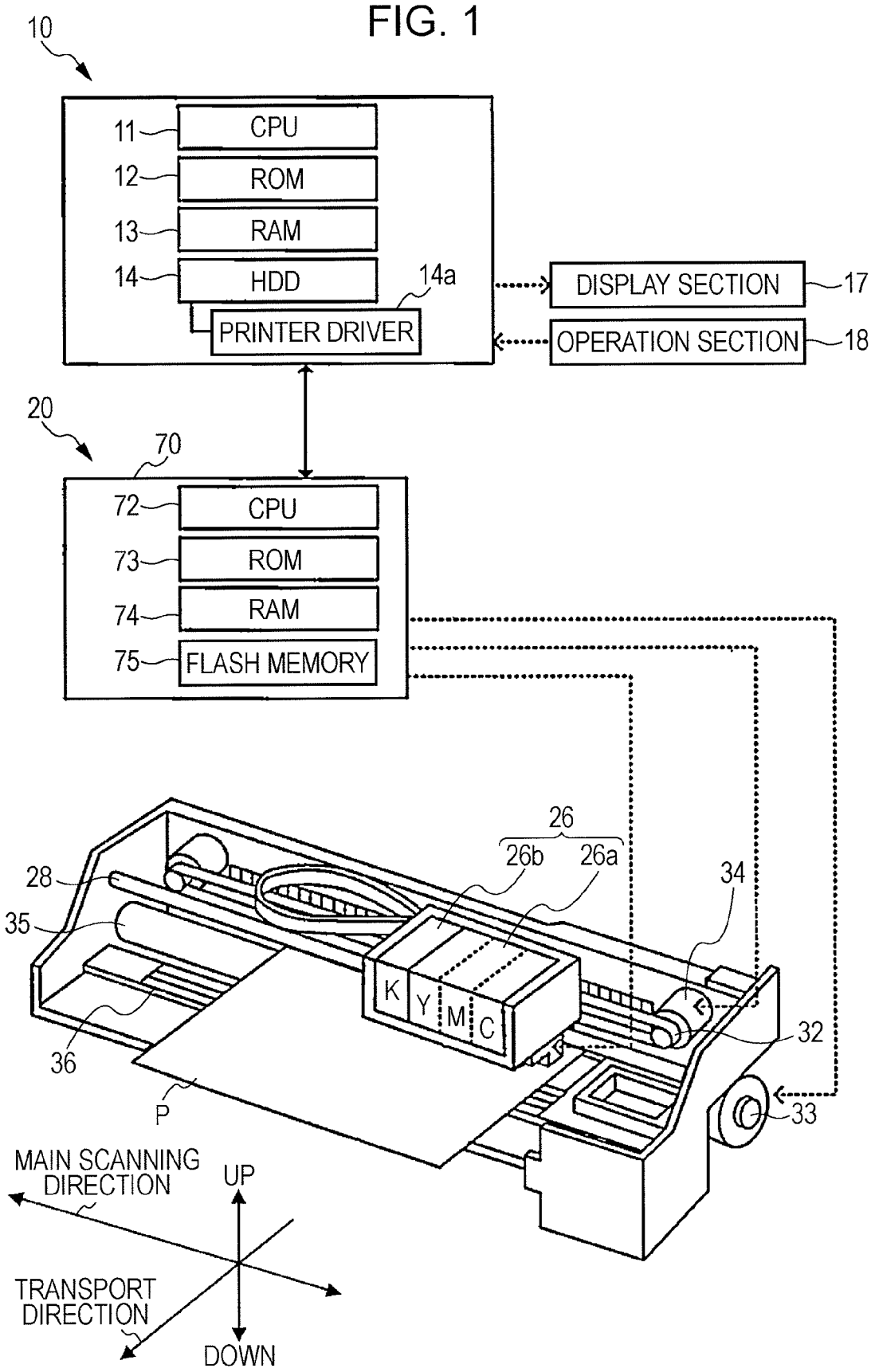
FIG. 1 is a configuration diagram schematically illustrating a configuration of a user PC 10 and an ink jet printer 20.

Hereinafter, the preferred embodiments for carrying out the invention will be described with reference to the accompanying drawings. FIG. 1 is a configuration diagram schematically illustrating a configuration of a user PC 10 and an ink jet printer 20 as printing apparatuses according to embodiments of the invention.

As shown in FIG. 1, the user PC 10 is formed as a microprocessor centered around a CPU 11, and includes a ROM 12 for storing various processing programs, a RAM 13 for temporarily storing data, an HDD 14 for storing various application software and various data, a display section 17 for displaying various information, an operation section 18 such as a keyboard or a mouse for inputting various instructions from the user, and an input/output port, which is not shown, connected with the ink jet printer 20 and the like. The HDD 14 stores a printer driver 14*a* used when performing various processes for printing or for performing transmission and reception of data such as the print status information of a print job between the computer 10 and the ink jet printer 20.

As shown in FIG. 1, the ink jet printer 20 includes: a sheet feeding roller 35 which transports a paper P forward from the rear side in the transport direction shown in the drawing above a platen 36 by driving a driving motor 33; a carriage 22 which is mounted on a carriage belt 32 and is driven by a carriage motor 34 to reciprocate in a left-right direction (a main scanning direction) along a guide 28; an ink cartridge 26 which has a three-color cartridge 26*a* mounted on the carriage 22 and formed integrally so as to contain color inks of cyan (C), magenta (M), and yellow (Y), and a black cartridge 26*b* for containing an ink of black (K); a print head 24 on which a nozzle 23 is formed to eject ink droplets by pressurizing the inks supplied from the ink cartridge 26; and a controller 70 which controls the whole apparatus. Since the three-color cartridge 26*a* is formed integrally, each color ink in the cartridge can not be replaced individually. Accordingly, when any one of the color inks runs out, it is necessary to replace all the inks in the three-color cartridge 26*a* although there are sufficient residual amounts of the other inks. Furthermore, the print head 24 may adopt a system which transforms piezoelectric elements to pressurize the ink by applying a voltage to the piezoelectric elements. In addition, the print head 24 may adopt a system which heats the ink by applying a voltage to a heating resistor (for example, a heater) and generates vapors to pressurize the ink.

Figure 2:
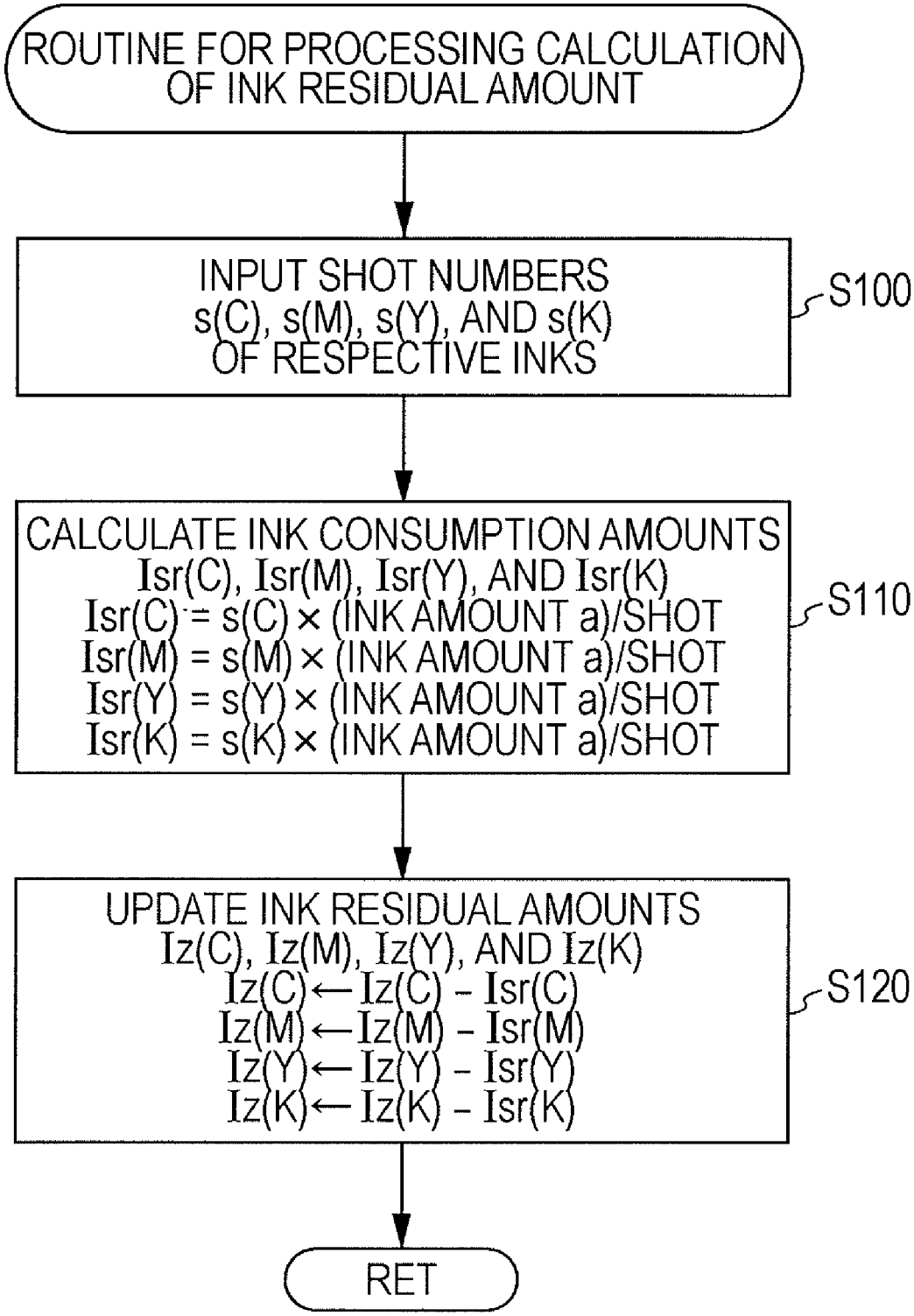
FIG. 2 is a flowchart illustrating an example of a routine for processing the calculation of the ink residual amount.

The controller 70 is formed as a microprocessor centered on a CPU 72, and includes a ROM 73 for storing various processing programs, a RAM 74 for temporarily storing data, a flash memory 75 which is electrically rewritable for retaining data even when a power supply is turned off and an input/output port which is not shown. A print job and the like are input to the controller 70 from the printer driver 14*a* of the user PC 10. The controller 70 outputs a control signal to the print head 24, a control signal to the driving motor 33, and a control signal to the carriage motor 34. In addition, the controller 70 outputs print status information and the ink residual amount to the user PC 10. Here, a value calculated by the CPU 72 is used as the ink residual amount. FIG. 2 is a flowchart illustrating an example of a routine for processing the calculation of the ink residual amount which is executed by the CPU 72 whenever the printing of an image is completed. Hereinafter, the above-mentioned routine will be described. Furthermore, the calculation processing of the ink residual amounts is common to all the ink colors. Accordingly, the processing of cyan (C) will be described (FIG. 2 shows all the inks).

When the routine for the processing the calculation of the ink residual amount is executed, the CPU 72 of the controller 70 inputs a shot number s(C) which is the number of times the ink droplet ejected from the nozzle 23 while this routine has been executed from the previous time to the current time (step S100). Then, the CPU 72 calculates an ink consumption amount Isr(C) by multiplying the ejected ink amount per one shot by the shot number s(C) (step S110). Subsequently, the CPU 72 performs an update so that a new ink residual amount Iz(C) is set to a value obtained by subtracting the ink consumption amount Isr(C) from the ink residual amount Iz(C) which is calculated in the previous routine and registered in the flash memory 75 (step S120). Then, this routine is terminated. Hereinafter, each of the ink residual amounts Iz(C), Iz(M), Iz(Y), and Iz(K) of the respective inks are simply referred to as an ink residual amount Iz. In such a manner, the calculated ink residual amount Iz and the print status information are transmitted to the user PC 10 whenever printing is completed. Further, the controller 70 determines that the ink has run out if any one of the ink residual amounts Iz of the inks is lower than a predetermined threshold value for the level of ink. Then, the controller 70 transmits information on the lack of ink to the PC 10 and stops the printing process. The user PC 10, receiving the information on the lack of ink, displays a warning to the effect that the ink has run out on the display section 17 by using the printer driver 14*a*.

Figure 3:
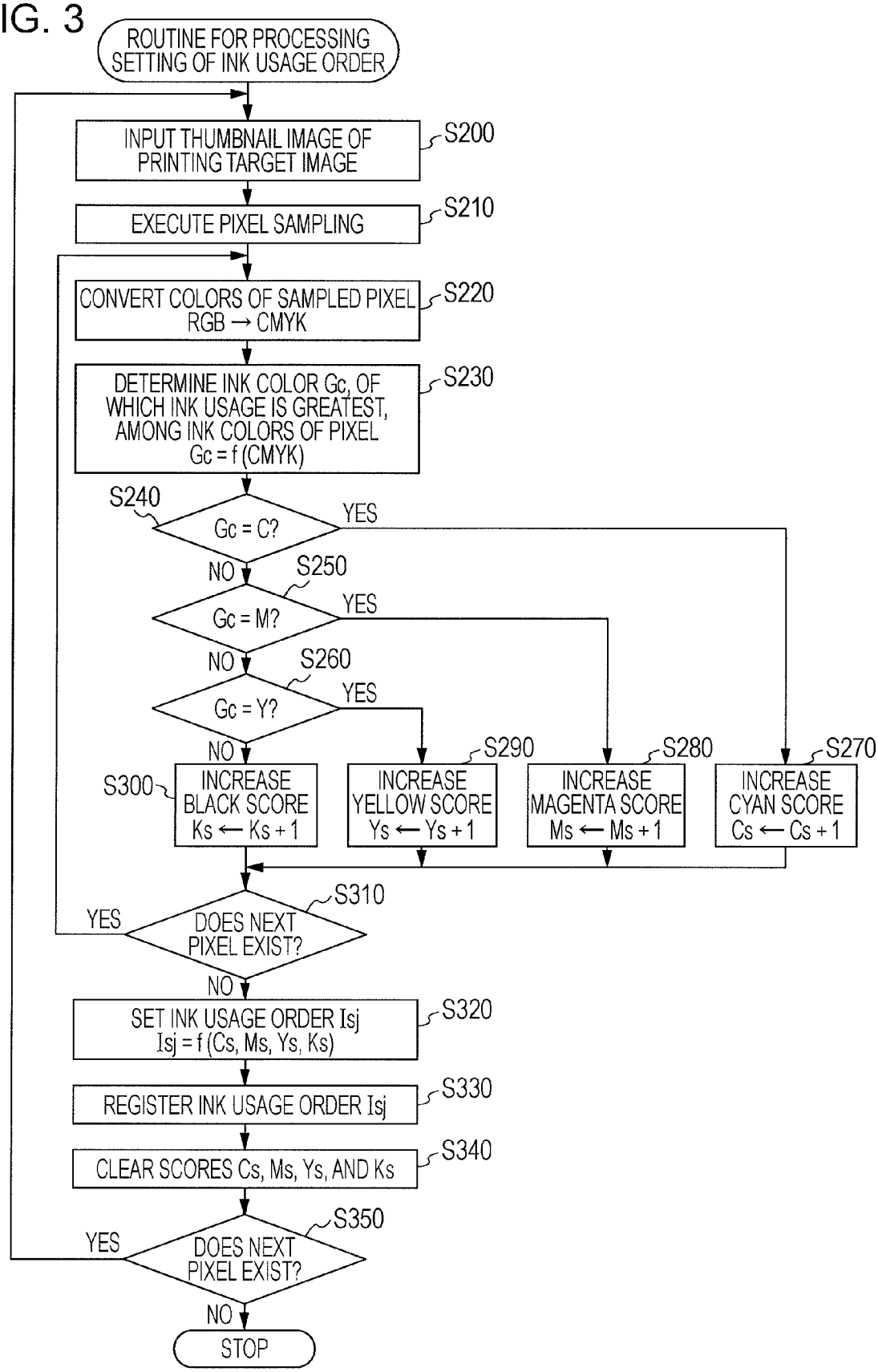
FIG. 3 is a flowchart illustrating an example of a routine for processing the setting of the ink usage order.
Figure 6:
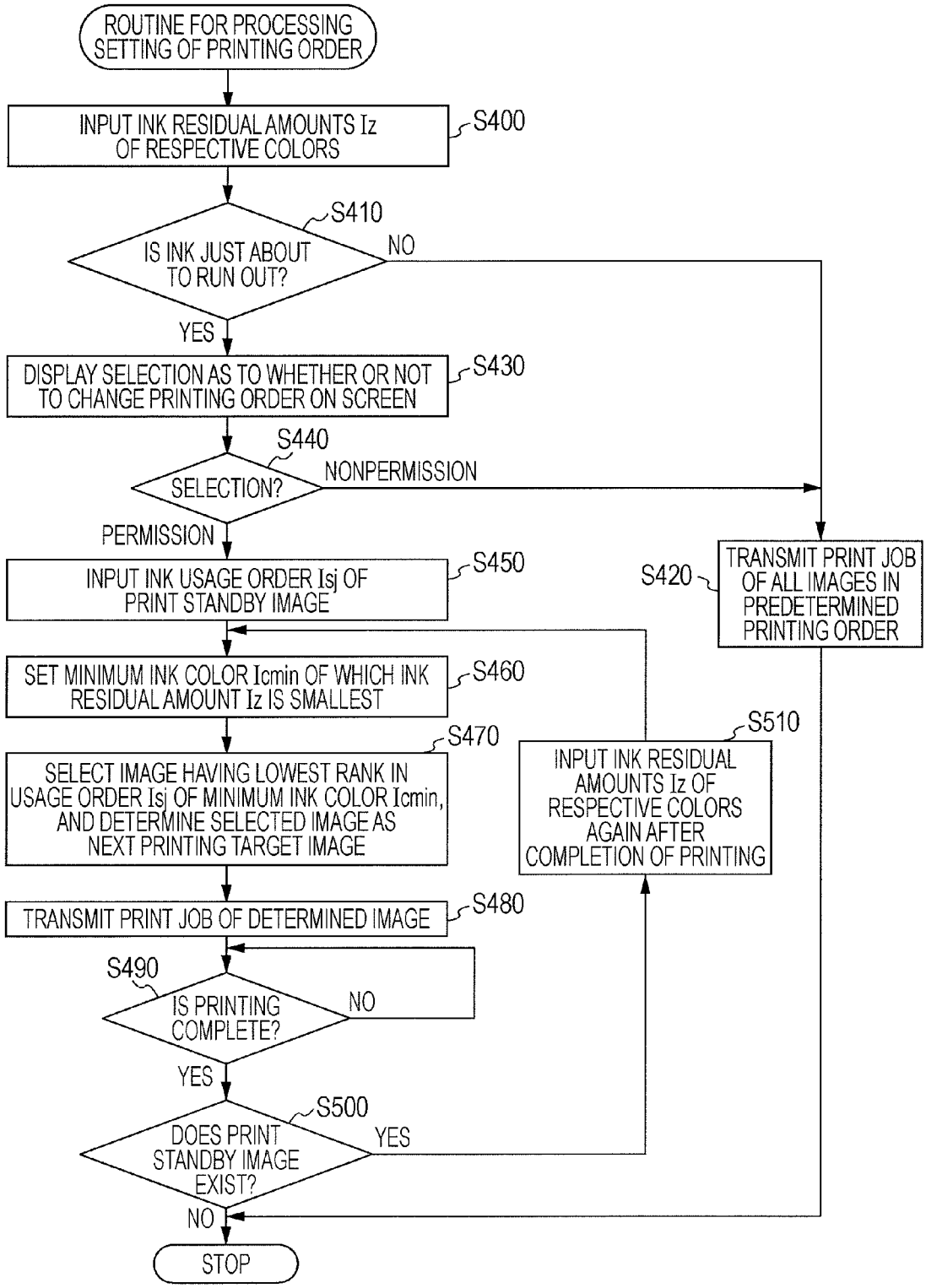
FIG. 6 is a flowchart illustrating an example of a routine for processing the setting of the printing order.

Next, the operation of the user PC 10 as an example as configured as described above and particularly the operation will be described when a user selects a plurality of images during execution of application program and assigns the color printing process. The CPU 11 of the user PC 10 executes a processing of prioritizing amounts of inks used in an image selected as a printing target by using the printer driver 14*a* when receiving an assignment of the color printing process, executes a process for setting a printing order, and thus transmits a print job to the ink jet printer 20. FIG. 3 is a flowchart illustrating an example of a routine for processing the setting of the ink usage order for the prioritizing the usages of the inks. FIG. 6 is a flowchart illustrating an example of a routine for processing the setting of the printing order. Hereinafter, the processings will be sequentially described.

Figure 4:
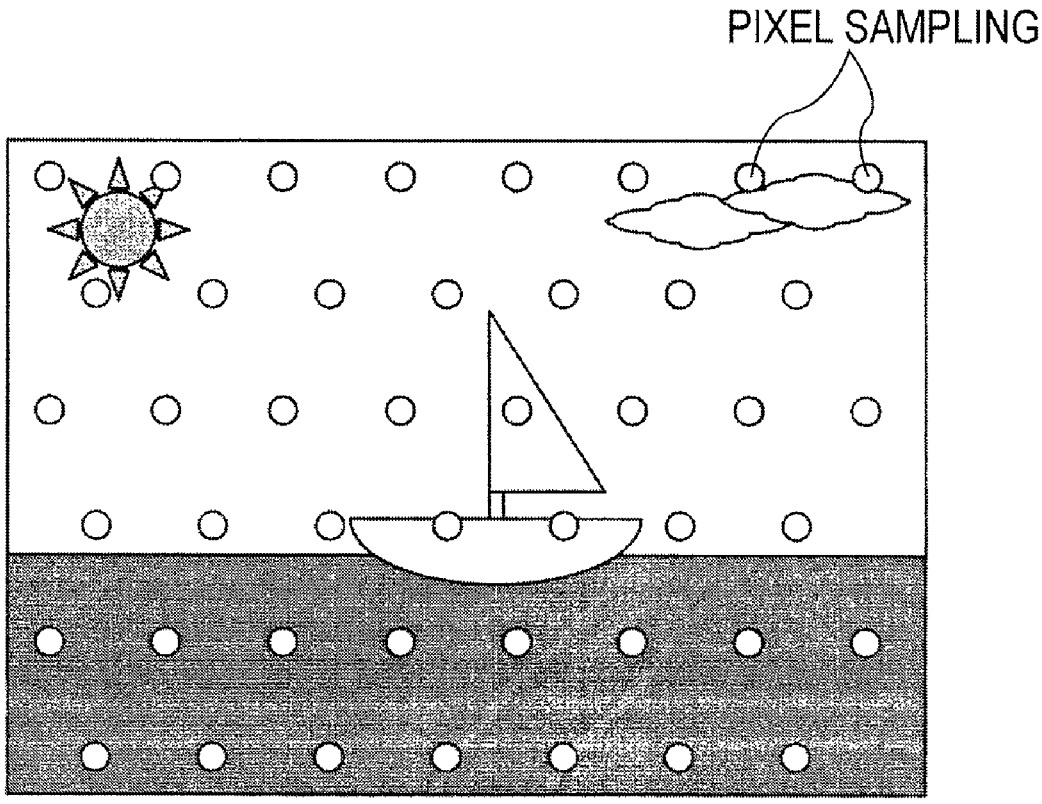
FIG. 4 is an explanatory diagram illustrating an example of sampling pixels.

First, the routine for processing the setting of the ink usage will be described with reference to FIG. 3. In the routine for processing the setting of the ink usage order, first, the CPU 11 inputs an thumbnail image of a printing target image (step S200), and samples a plurality of pixels from the input thumbnail image (step S210). FIG. 4 shows a method of sampling the pixels. As shown in the drawing, the sampling is multiply performed on the whole image so that the tendency of the usage of the inks required for the printing of the image can be monitored. Next, color conversion is performed so that RGB values of the sampled pixels are converted into CMYK values which have multilevel gradation values (for example, 256 levels of 0 to 255) represented on the basis of the CMYK color space (step S220). The color conversion is performed in the following way: a look-up table, not shown, associating the RGB gradation values with the CMYK gradation values is previously stored in the HDD 14, and when RGB values of the pixels are input through the sampling, the CMYK values are derived by referring to the look-up table.

Subsequently, an ink color Gc is determined of which the ink usage is greatest among the ink colors constituting the pixel on the basis of the color-converted CMYK values (step S230). Then, it is determined whether or not the determined ink color Gc is cyan (C) (step S240), magenta (M) (step S250), or yellow (Y) (step S260). If it is determined that the ink color Gc is cyan (C), a cyan score Cs is increased by only 1 point (step S270). If it is determined that the ink color Gc is magenta (M), a magenta score Ms is increased by only 1 point (step S280). If it is determined that the ink color Gc is yellow (Y), a yellow score Ys is increased by only 1 point (step S290). If it is determined that the ink color Gc does not correspond to any one of cyan (C), magenta (M), and yellow (Y), a black score Ks is increased by only 1 point (step S300). Here, the values of the cyan score Cs, the magenta score Ms, the yellow score Ys, and the black score Ks (hereinafter, the scores) are values respectively representing the number of pixels in which usages of cyan (C), magenta (M), yellow (Y), and black (K) are the greatest and are temporarily registered in the RAM 13. Then, it is determined whether or not the next pixel exists (step S310). If it is determined that the next pixel exists, the processing from step S220 is repeated. If it is determined that the next pixel does not exist, an ink usage order Isj is set which is a descending order of ink usages required for the printing of the image on the basis of the score values (step S320). There is a tendency that the ink usages required for the printing of the image increase as the values of the scores are larger. Thus, the ink usage order Isj is set so that the higher priory is given to the larger score value.

Figure 5:
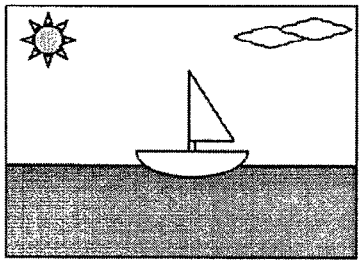
FIG. 5 is an explanatory diagram illustrating an example of an ink usage order Isj for an image.
Figure 5:
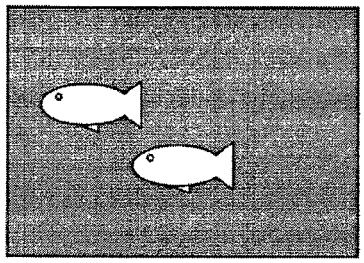
Figure 5:
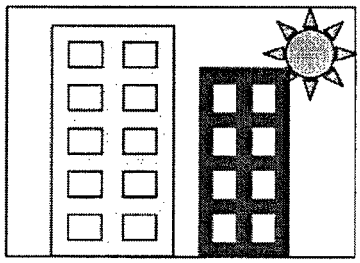
Figure 5:
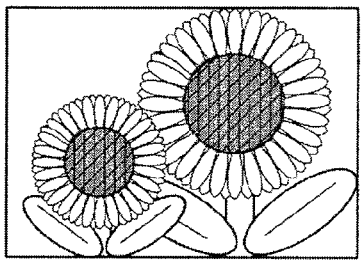
Figure 5:
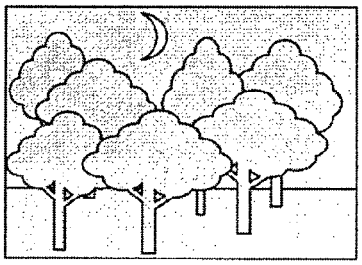

In such a manner, the ink usage order Isj is registered in the RAM 13 (step S330), and the values of the scores Cs, Ms, Ys, and Ks are cleared (step S340). Then, it is determined whether or not the next printing target image exists (step S350). If the next image exists, the processing from step S200 is repeated, and if the next image does not exist, this routine is terminated. FIG. 5 shows an example of the ink usage order Isj set by the routine for processing the setting of the ink usage order. As shown in the drawing, for example, the ink which is most frequently used in the image of No. 1 is cyan (C), and the subsequent usage order is the order of magenta (M), yellow (Y), and black (K). Likewise, inks used in each image are registered in the ink usage order Isj which is a descending order of the ink usages. Furthermore, the image, which a print job has been transmitted in a routine for processing the setting of the printing order as described below, is sequentially removed from the list of the usage order Isj.

Next, the routine for processing the setting of the printing order will be described with reference to FIG. 6. In the routine for processing the setting of the printing order, first, the CPU 11 inputs the ink residual amounts Iz of the respective colors (step S400). Here, the input ink residual amounts Iz are calculated by the above-mentioned routine for processing the calculation of the ink residual amount of FIG. 2, and are transmitted from the controller 70. Next, it is determined whether or not the ink is just about to run out on the basis of the input ink residual amount Iz (step S410). Here, the determination as to whether or not the ink is just about to run out is based on whether or not the ink residual amount Iz is slightly larger than the predetermined threshold value for the level of ink. For example, the determination may be based on whether or not an initial ink fill ratio is lower than 5 to 10%. If it is determined that the ink is not just about to run out in step S410, it is not necessary to change the printing order. Hence, the print job is transmitted to the ink jet printer 20 by using the printer driver 14*a* so that all the images are printed in the predetermined printing order (step S420), and this routine is terminated. Here, the predetermined printing order may be set as, for example, an ascending order of file numbers which are set as per a user selection order of the printing target images or in the photographing order obtained when the images are photographed by using a digital camera.

On the other hand, if it is determined that any one ink is just about to run out in step S410, a screen for selecting a change of printing order, which is not shown, for allowing a user to select whether or not to permit a change of the printing order of the images is displayed on the display section 17 (step S430). Then, the operation by a user's for selecting any one out of "permitted" or "not permitted" is waited for (step S440). The screen for selecting a change of printing order displays a message to the effect that the ink is very likely to run out during printing or the running out of the ink can be delayed when a change of the printing order is permitted, thereby promoting permission to change the printing order. If "not permitted" is selected in step S440, the printing order is not changed, the print job is transmitted so that all the images are printed in the predetermined printing order in step S420, and this routine is terminated.

Figure 7A:
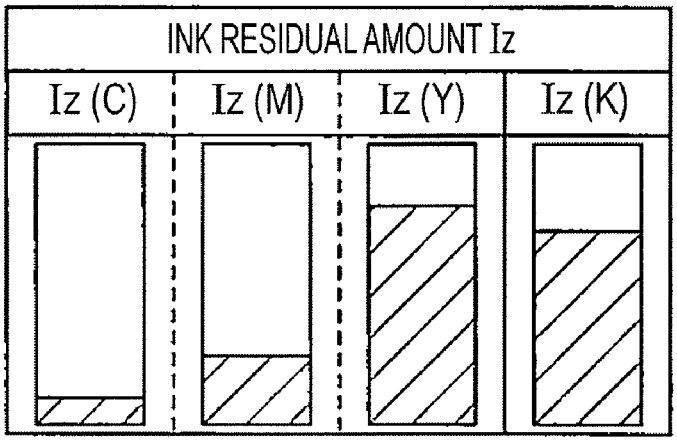
FIGS. 7A and 7B are explanatory diagrams illustrating an example of determining a next printing target image.
Figure 7B:
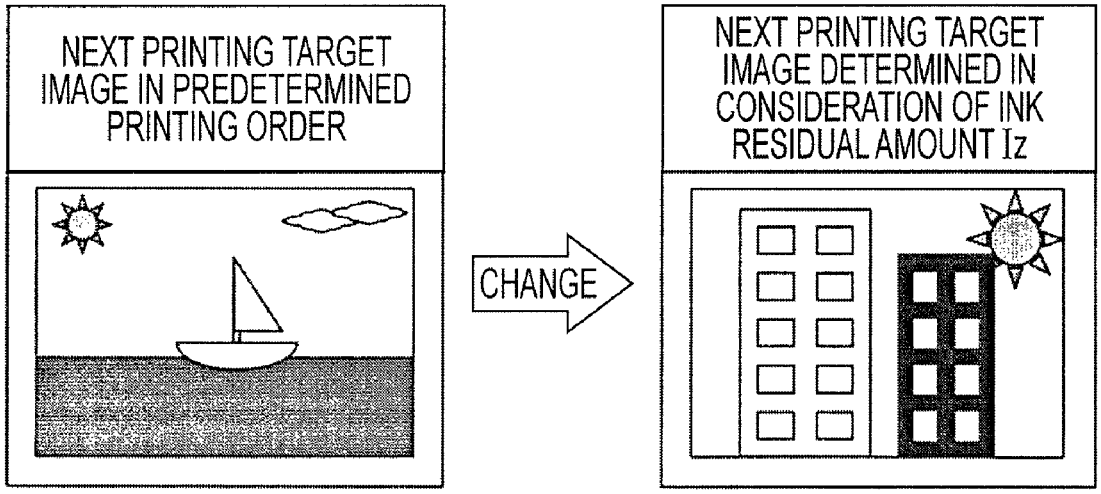

On the other hand, if "permitted" is selected in step S440, the ink usage order Isj of the print standby image, which is set by the above-mentioned routine for the processing of setting the ink usage order of FIG. 3, is input (step S450). Next, a minimum ink color Icmin is set which has the smallest ink residual amount Iz (step S460). Then, the image, which has the lowest rank in the usage order Isj of the set minimum ink color Icmin, is determined as the next printing target image (step S470). Here, the lowest-ranked image corresponds to the fourth-ranked image in the usage order Isj of the minimum ink color Icmin since the number of ink colors are four in this example, and when a plurality of the fourth-ranked images exist, the lowest-ranked image is determined as the smaller ranked one of those in the predetermined printing order number. FIGS. 7A and 7B show an example of the determining of the next printing target image. FIG. 7A shows the ink residual amounts Iz of the inks. FIG. 7B shows an example of the determining of the next printing target image by changing the next printing target image from that determined in the predetermined printing order. In the example of FIGS. 7A and 7B, cyan (C) corresponds to the minimum ink color Icmin, and the next printing target image determined in the predetermined printing order is not the fourth-ranked image but the first-ranked image in the rank of cyan (C) in the ink usage order Isj (refer to FIG. 5). Hence, the image of No. 3 having the fourth cyan (C) rank is determined as the next printing target image. When the next printing target image is determined, the print job is transmitted by using the printer driver 14*a* so that the determined image is printed (step S480). Since the next printing target image is determined and the print job is transmitted in such a manner, printing is performed sequentially from the images having the smaller usages of the ink of the minimum ink color Icmin. Therefore, it is possible to delay the time until the ink of the minimum ink color Icmin runs out. Specifically, in the example of FIGS. 7A and 7B, when the next image is printed in the predetermined printing order, the ink of cyan (C) runs out, and thus the cartridge 26*a* is very likely to be replaced regardless of whether or not the residual amounts of the other inks are sufficient. However, in this example, it is possible to delay the time until the ink of cyan (C) running out by changing the printing order. In addition, when the printing order is changed, only the next printing target image is determined. Therefore, there is no problem in the time required for the change of the printing order.

When the print job is transmitted, completion of the printing is waited for (step S490). Here, the completion of the printing is determined on the basis of the print status information transmitted from the ink jet printer 20. When the printing is completed, it is determined whether or not the print standby image exist (step S500). If the print standby image exist, the ink residual amounts Iz of the colors after completion of the printing is input again (step S510), and the processing from the step S460 is repeated. Here, the routine for processing the calculation of the ink residual amount of FIG. 2 is executed whenever the printing of each image is completed as described above. Accordingly, it is possible to input the latest ink residual amount Iz after completion of the printing in step S510. Hence, in examples FIGS. 7A and 7B, when the ink residual amount Iz of magenta (M) becomes smaller than that of cyan (C) during the repetition of the processing, magenta (M) is newly set as the minimum ink color Icmin in step S460, thereby determining the lowest-ranked (fourth-ranked) image in the usage order Isj of magenta (M) as the next printing target image in step S470. As described above, it is possible to more precisely determine the next printing target image in consideration of the latest ink residual amount Iz after the completion of the printing. On the other hand, if the print standby image does not exist in step S500, this routine is terminated.

Here, a relationship between the constituent elements according to the embodiment and the constituent elements according to the aspect of the invention is clarified. The CPU 72 of the printer 20, which executes the processing of the routine for processing the calculation of the ink residual amount calculation processing shown in FIG. 2, according the embodiment corresponds to the "residual amount acquisition section" according to the aspect of the invention. The CPU 11 of the user PC 10, which receives the instruction when a user selects the plurality of images during execution of the application program so as to instruct the color printing process, corresponds to the "print instruction receiving section". The CPU 11 of the user PC 10, which executes the processing of the ink usage order acquisition processing routine shown in FIG. 3 by using the printer driver 14*a*, corresponds to the "required amount information acquisition section". The CPU 11 of the user PC 10, which executes the processing of step S400 to S420 and S450 to S510 of the routine for processing the setting of the printing order shown in FIG. 6 by using the printer driver 14*a*, corresponds to the "control section" according to the aspect of the invention. In addition, the CPU 11 of the user PC 10, which executes the processing of step S430 to S440 of routine for processing the setting of the printing order shown in FIG. 6 by using the printer driver 14*a*, corresponds to the "printing order change instruction receiving section" according to the aspect of the invention. Furthermore, in the embodiment, the operation of the user PC 10 is described, thereby clarifying an example of the print control method according to an aspect of the invention.

The above-mentioned user PC 10 according to the embodiment is characterized as follows. When a plurality of images instructed to be printed exists, and when it is determined that an ink is just about to run out on the basis of the input ink residual amounts Iz of the colors and a user permits the printing order change, the fourth-ranked image is determined, which has lowest rank in the usage order Isj of the minimum ink color Icmin having the smallest ink residual amount Iz, and becomes the next printing target image. Hence, it is possible to delay the time when the ink of the minimum ink color Icmin runs out, and thus it is possible to print as many images as possible before the ink runs out.

Furthermore, whenever the printing of each image is completed, each ink residual amount Iz is input again. Hence, it is possible to more precisely determine the next printing target image on the basis of the latest ink residual amount Iz. Further, since only the next printing target image is determined, it is possible to prevent delays in the time required to determine the printing order. In addition, since a user has to select whether or not to permit the printing order change, it is possible to prevent an image from being printed in a printing order unpredictable to the user. In addition, the ink usage order Isj required for the printing of the image is set on the basis of the ink usage required for the plurality of sampled pixels extracted from the image instructed to be printed. Hence, it is possible to promptly acquire the tendency of ink usage required for the printing of the image in a simple and easy process. In addition, the ink usage order Isj is set as the descending order of the ink usages required for the printing of the image. Hence, it is possible to promptly select the image as compared with a way of comparing the ink usages to each other when the next printing target image is being determined.

Furthermore, the invention is not limited to the above-mentioned embodiment, and it is apparent that various modifications and variations may be made without departing from the technical scope of the invention.

In the embodiment, the ink color Gc of a greatest usage among the ink colors constituting each pixel is determined, and thereby the ink usage order Isj is set on the basis of the counted ink scores. However, the ink usages required for the printing of the image may be calculated by accumulatively calculating the usages of the inks constituting each pixel, and the ink usage order Isj may be set on the basis of the calculated usages. Furthermore, the invention is not limited to the way of setting the ink usage order Isj, and the calculated ink usage may be used intact. In this case, the image in which the usage of the ink of the minimum residual amount ink color Icmin is the smallest may be determined as the next printing target image.

In the embodiment, the selection as to whether to permit the change of the printing order is performed before start of the printing. However, the invention is not limited to the way in which the selection is performed before start of the printing. Accordingly, the printing may be performed in the predetermined printing order when there is sufficient ink, and the selection as to whether to permit the change of the printing order may be performed when just before the ink is to run out during the printing operation. Further, the selection may not need to be performed by a user, and the printing order may be automatically changed when the ink is just about to run out.

In the embodiment, the ink cartridge 26 includes the black cartridge 26*b* and the three-color cartridge 26*a* which is formed integrally so that the inks of the three colors of cyan (C), magenta (M), and yellow (Y) are unable to be individually replaced. However, the combination between the ink colors and the cartridges is not limited to this. For example, it may be possible to adopt four-color cartridge which is formed integrally so that inks of four colors of cyan (C), magenta (M), yellow (Y), and black (K) are unable to be individually replaced. In addition, it may be also possible to adopt a cartridge in which each ink of colors is formed separately and is able to be individually replaced. Further, the ink colors are not limited to the four colors of cyan (C), magenta (M), yellow (Y), and black (K). For example, it may be possible to use five colors or six colors including light cyan (LC), light magenta (LM), and the like. Alternatively, it may be possible to use an equal or higher number of colors.

In the embodiment, the ink residual amount Iz calculated by the routine for processing the calculation of the ink residual amount is used as an ink residual amount. However, the invention is not limited to this, and an ink residual amount directly detected by various sensors may be used. For example, it may be possible to use a residual amount detected by using an optical sensor in a way of making light incident in the ink cartridge and receiving reflected light or transmitted light which changes in accordance with the ink residual amount. In addition, it may be possible to a residual amount detected by using a weight sensor in a way of continuously measuring the weight of the ink cartridge which changes in accordance with the ink residual amount.

In the embodiment, the ink jet printer is used, but the invention is not limited to this, and a laser printer may be used. In this case, it is also possible to take the same advantage as the example by determining the next printing target image in accordance with the residual amount of the toner cartridge.

Figure 8:
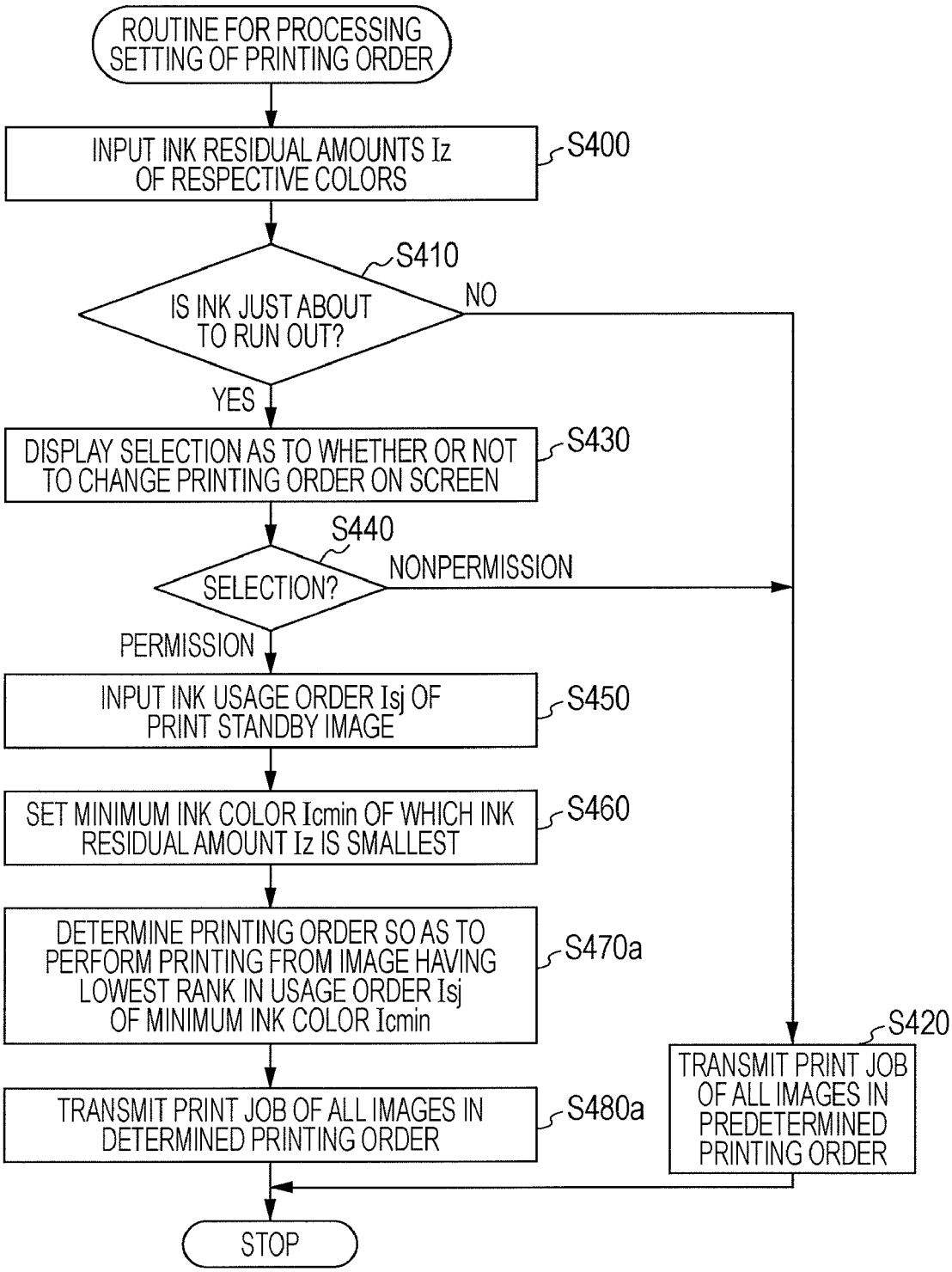
FIG. 8 is a flowchart illustrating an example of a routine for processing the setting of the printing order according to a modified example.
Figure 9A:
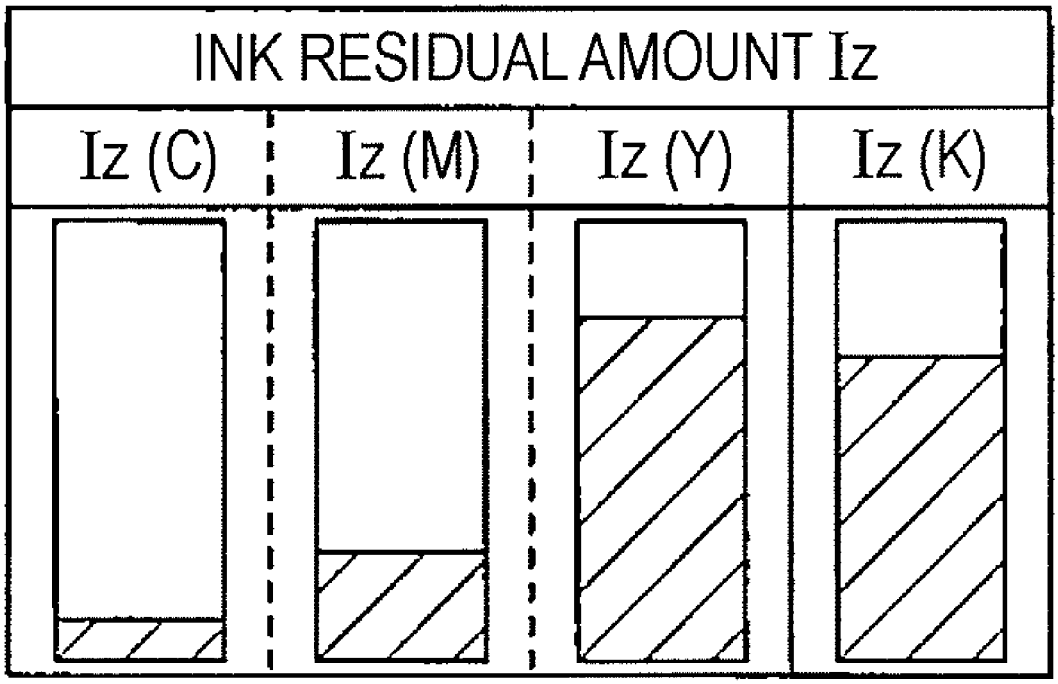
FIGS. 9A and 9B are explanatory diagrams illustrating an example of determining a printing order.
Figure 9B:
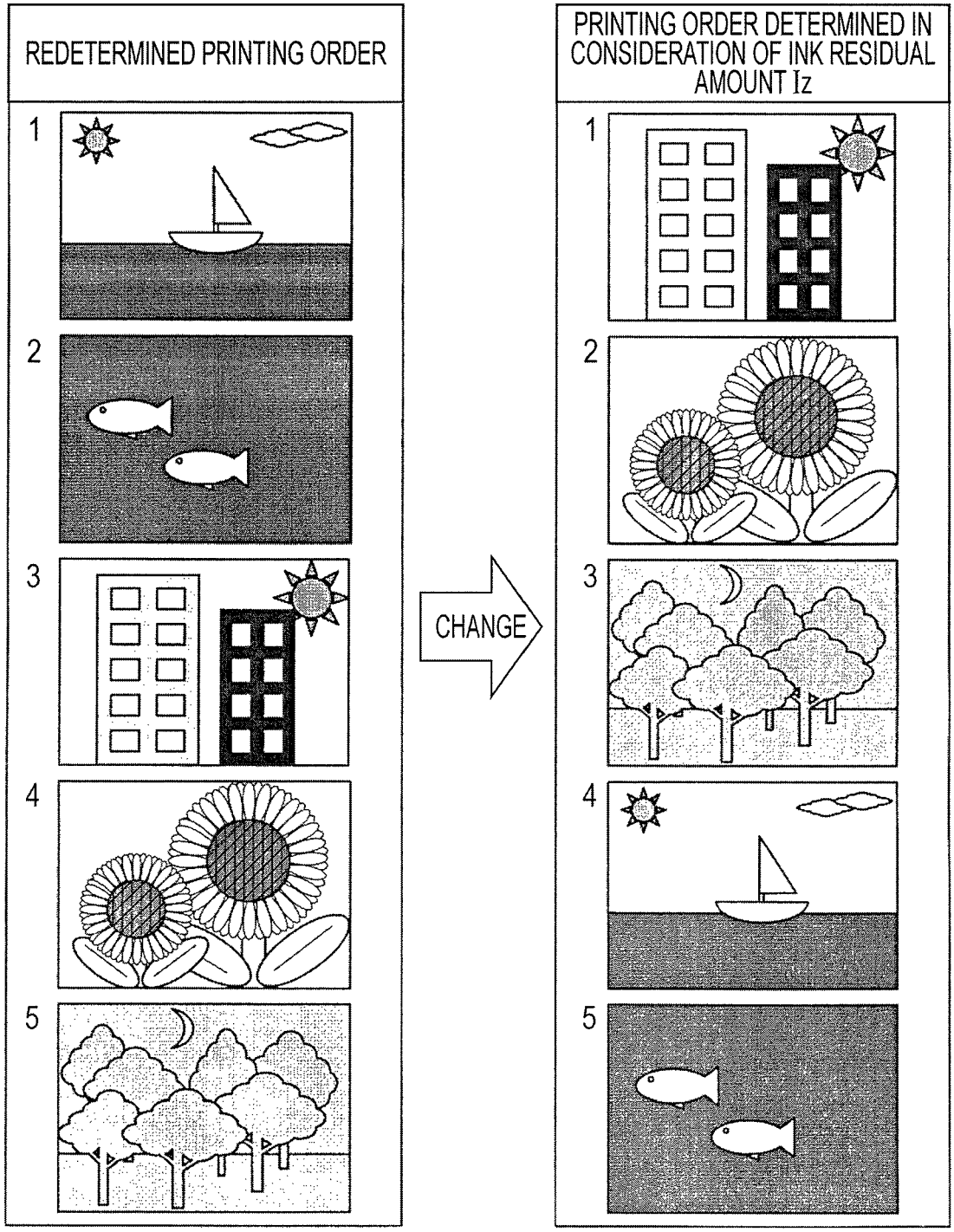

In the embodiment, the next printing target image is determined whenever the printing of an image is completed. However, the invention is not limited to this, and a plurality of next printing target images can be determined whenever two or more images are printed. Further, the invention is not limited to determining of the next printing target image during printing, and it may be possible to previously determine the printing order of all the images before start of the printing. In this case, FIG. 8 shows an example of the routine for processing the setting of the printing order which is executed by the CPU 11 of the user PC 10 with the aid of the printer driver 14*a*. In FIG. 8, the processing the same as that of the routine for processing the setting of the printing order shown in FIG. 6, will be referenced by the same reference numerals and signs, and detailed description thereof will be omitted. If the routine for processing the setting of the printing order is executed and the change of the printing order is permitted in step S440, the ink usage order Isj of the print standby image is input in step S450, and a minimum ink color Icmin which has the smallest ink residual amount Iz is set in step S460. Then, the printing order is determined so that the printing is performed sequentially from the image which has the lowest rank in the usage order Isj of the minimum ink color Icmin (step S470*a*). Subsequently, the print job is transmitted to the ink jet printer 20 by using the printer driver 14*a* so that all the images are printed in the determined printing order (step S480*a*), and this routine is terminated. Here, the printing order is determined so that the printing is performed sequentially from the lowest-ranked image. This means that in the modified example, the ranks of the ink usage order Isj are determined by rearranging those in an order of the fourth rank, the third rank, the second rank, and the first rank, and when a plurality of the same-ranked images exist, the smaller ranked one of those in the predetermined printing order number is determined to be first. FIGS. 9A and 9B show an example of determining the printing order. FIG. 9A shows the ink residual amounts Iz of the inks. FIG. 9B shows an example of determining the printing order by changing from the predetermined printing order. As shown in the drawings, cyan (C) corresponds to the minimum ink color Icmin, and the printing order is determined so that the printing is performed in an order from the lower-ranked image to higher-ranked image in the rank (refer to FIG. 5) of the cyan (C) in the ink usage order Isj. In such a manner, the printing order of all the images is previously determined before start of the printing. Hence, there is no problem due to the time required for the determination of the printing order during printing operations.

The embodiment has described the example in which the print control apparatus according to the embodiment of the invention is formed in the user PC 10. However, the invention is not limited to this, and the print control apparatus may be mounted on the printer itself. In addition, the ink jet printer 20 having only the printing function is used as the printing apparatus, but a multifunctional printer having a function of a scanner, and a combined printer such as a facsimile and a copier may be used.

What is claimed is:

1. A print control apparatus for controlling a printing apparatus that is able to perform color printing by using coloring agents of a plurality of colors, the print control apparatus comprising:

a residual amount acquisition section that acquires residual amounts of the coloring agents;

a print instruction receiving section that receives instruction for printing an image;

a required amount information acquisition section that acquires information on required amounts of the coloring agents for the image instructed to be printed; and a control section that performs a residual amount precedence print control for controlling the printing apparatus to preferentially perform printing of the image, among a plurality of images instructed to be printed, which requires the smallest amount of the coloring agent having the smallest residual amount on the basis of the acquired information on the required amount and the residual amounts of the coloring agents.

2. The print control apparatus according to claim 1, wherein the residual amount acquisition section is a section for acquiring the residual amounts whenever each single image is completely printed, and wherein the control section is a section for determining an image to be printed next time whenever each single image is completely printed.

3. The print control apparatus according to claim 1, wherein the control section is a section for previously determining a printing order of the plurality of images instructed to be printed before start of the printing.

4. The print control apparatus according to claim 1, further comprising a printing order change instruction receiving section that receives instruction as to whether or not to change a printing order of the plurality of images instructed to be printed from a user, wherein the control section is a section for performing the residual amount precedence print control when the printing order change instruction receiving section receives the instruction to change the printing order.

5. The print control apparatus according to claim 1, further comprising a pixel sampling section that extracts a plurality of pixels for sampling from the image instructed to be printed, wherein the required amount information acquisition section is a section for acquiring information on the required amount of the coloring agents for the extracted pixels.

6. The print control apparatus according to claim 1, wherein the required amount information acquisition section sets a priority of the coloring agents for each pixel in an ascending or descending order of the required amounts of the coloring agents for printing the image, and acquires the set priority of the coloring agents for each pixel as the required amount information.

7. The print control apparatus according to claim 1, wherein the printing apparatus includes coloring agents which are formed integrally with each other so that the coloring agents cannot be individually replaced.

8. The print control apparatus according to claim 1, wherein the printing apparatus is an apparatus for stopping the printing regardless of the instruction of the printing when any one of the coloring agents has run out.

9. A print control apparatus for controlling a printing apparatus that is able to perform color printing by using coloring agents of a plurality of colors and to stop the printing when any one of the coloring agents runs out, the print control apparatus comprising:

a residual amount acquisition section that acquires residual amounts of the coloring agents;

a print instruction receiving section that receives instruction for printing an image;

a required amount information acquisition section that acquires information on the required amounts of the coloring agents for the image instructed to be printed; and a control section that sets a printing order so as to print the maximum number of a plurality of the images, which are instructed to be printed, until any one of the coloring agents has run out on the basis of the acquired information on the required amount and the residual amounts of the coloring agents, and controls the printing apparatus to print the image on the basis of the set printing order.

10. A print control method for controlling a printing apparatus that is able to perform color printing by using coloring agents of a plurality of colors, the print control method comprising:

acquiring residual amounts of the coloring agents;

receiving instruction for printing an image;

acquiring required amount information on required amounts of the coloring agents for the image instructed to be printed; and performing residual amount precedence print control for controlling the printing apparatus to preferentially perform printing of the image, among a plurality of images instructed to be printed, which requires the smallest amount of the coloring agent having the smallest residual amount on the basis of the acquired information on the required amount and the residual amounts of the coloring agents.

* * * * *